US006000264A

United States Patent [19]

Chang

[11] Patent Number: 6,000,264

[45] Date of Patent: Dec. 14, 1999

[54] DRIVING MECHANISM FOR MOVING A CUTTER OR PITCH CONTROL ROD IN A SPRING FORMING MACHINE

[75] Inventor: Yi-Shan Chang, Kaohsiung, Taiwan

[73] Assignee: Tzyh Ru Shyng Automation Co., Ltd., Kaohsiung, Taiwan

[21] Appl. No.: 09/175,858

[22] Filed: Oct. 20, 1998

[51] Int. Cl.[6] ..... B21F 11/00

[52] U.S. Cl. ..... 72/132; 74/49; 74/50

[58] Field of Search ..... 72/129, 132, 133, 72/135, 137, 138, 140, 446, 447, 441, 429; 74/49, 50, 55

[56] References Cited

U.S. PATENT DOCUMENTS

| | | | |
|---|---|---|---|
| 3,451,276 | 6/1969 | Wadlow et al. | 74/50 |
| 4,272,996 | 6/1981 | Sauerwein | 72/50 |
| 4,939,944 | 7/1990 | Hou | 74/50 |

*Primary Examiner*—Rodney Butler
*Attorney, Agent, or Firm*—Merchant & Gouls P.C.

[57] ABSTRACT

A spring forming machine includes a machine frame, a movable member, and a driving mechanism. The driving mechanism comprises a slide plate seat, a slide plate and a cam wheel. When fitting an eccentric pin unit and a filler within a horizontal slide slot in the slide plate, the slide plate seat rotates on the machine frame, and the slide plate moves on the slide plate seat so as to move the movable member along an elliptical path upon actuation. When locking the slide plate seat and removing the filler, the cam wheel moves the eccentric pin unit so as to move the slide plate on the slide plate seat and thus to move the movable member along a straight path upon actuation. When locking the slide plate seat and removing the eccentric pin unit and the filler, a follower shaft can be mounted removably on the slide plate in contact with the cam wheel to permit a straight movement of the movable member on the machine frame upon actuation.

6 Claims, 14 Drawing Sheets

DRIVING MECHANISM FOR MOVING A CUTTER OR PITCH CONTROL ROD IN A SPRING FORMING MACHINE

BACKGROUND OF THE INVENTION

1. Field of the Invention

This invention relates to a spring forming machine, more particularly to a driving mechanism for moving a cutter or pitch control rod in a spring forming machine.

2. Description of the Related Art

Referring to FIG. 1, a conventional spring forming machine 1 is shown to include a cutting device 10, a pitch control device 11, a pair of feeding rollers 12, two bending devices 13, and a positioning horizontal cylinder 14. A metal strip 15 is pushed by the feeding rollers 12 to extend between the positioning horizontal cylinder 14 and the bending devices 13, thereby forming a turn around the positioning horizontal cylinder 14. A pitch control rod 110 of the pitch control device 11 effects a vertical movement, and has an oblique top surface that presses against the metal strip 15 to define a predetermined pitch for a coiled spring to be formed. By adjusting the pitch control device 11, coiled springs of different pitches can be formed. After a coiled spring of a predetermined length has been formed, a cutter 100 of the cutting device 10 moves downward to cut off the coiled metal strip 15.

Each of the cutting device 10 and the pitch control device 11 has a driving mechanism. Referring to FIG. 2, the driving mechanism 2 is shown to include a slide plate seat 21 which is adapted to be fixed on a machine frame (not shown), a slide plate 22, a holder 23, a power source 24, and a linkage assembly 25. The holder 23 is used to hold the cutter 100 (see FIG. 1) or the pitch control rod 110 (see FIG. 1) thereon. The linkage assembly 25 includes a connector 250, a swing arm 251 coupled with the slide plate 22 by means of the connector 251 at an end thereof, a shaft 252 connected fixedly to the other end of the swing arm 251 at an end thereof, a swing arm 253 connected fixedly to the other end of the shaft 252 at an end thereof, a slide member 254 attached to the other end of the swing arm 253, and a rotary wheel 255. The shaft 252 is journalled on the machine frame (not shown). The slide member 254 is received slidably in an irregular-shaped guide slot 256 in the rotary wheel 255. The power source 24 rotates the rotary wheel 255 to move the slide plate 22 within the slide plate 21. The aforementioned driving mechanism 2 suffers from the following disadvantages:

(1) Because the linkage assembly 25 consists of numerous members 250, 251, 252, 253, 254, 255, it is difficult to control accurately the pitch of the spring to be formed.

(2) Referring to FIG. 3, because the cutter 110 (see FIG. 1) moves on the machine frame (not shown) along a straight path, a sharp projection 152 is present on an end surface 151 of a coiled spring 150, which is formed by the conventional spring forming machine 1 (see FIG. 1).

SUMMARY OF THE INVENTION

An object of this invention is to provide a spring forming machine with a driving mechanism which consists of a minimum number of members to facilitate accurate pitch control.

Another object of this invention is to provide a spring forming machine with a driving mechanism which can move a cutter along an elliptical path to prevent formation of a sharp projection on an end surface of a spring to be formed.

According to this invention, a spring forming machine includes a machine frame, a movable member, and a driving mechanism for moving the movable member on the machine frame. The driving mechanism includes a slide plate seat which is rotatable about a rotating shaft on the machine frame, a slide plate which is slidable along a vertical slide slot in the slide plate seat, and a cam wheel which is driven by a power source to rotate. An eccentric pin unit is connected to the cam wheel. The pin unit and a filler are fitted within a horizontal slide slot in the slide plate. Upon actuation of the power source, the slide plate seat rotates on the machine frame, and the slide plate moves on the slide plate seat so as to move the movable member on the machine frame along an elliptical path, thereby preventing formation of a sharp projection on an end surface of a coiled spring to be formed. When the slide plate seat is locked on the machine frame, and when the filler is removed from the slide plate, upon actuation of the power source, the eccentric pin unit slides in the horizontal slide slot in the slide plate so as to move the slide plate on the slide plate seat, thereby moving the movable member on the machine frame along a straight path. Alternatively, when the slide plate seat is locked on the machine frame, and when the eccentric pin unit and the filler are removed from the slide plate, a follower shaft can be mounted removably on the slide plate in contact with the cam wheel to permit a straight movement of the movable member on the machine frame upon actuation of the power source.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
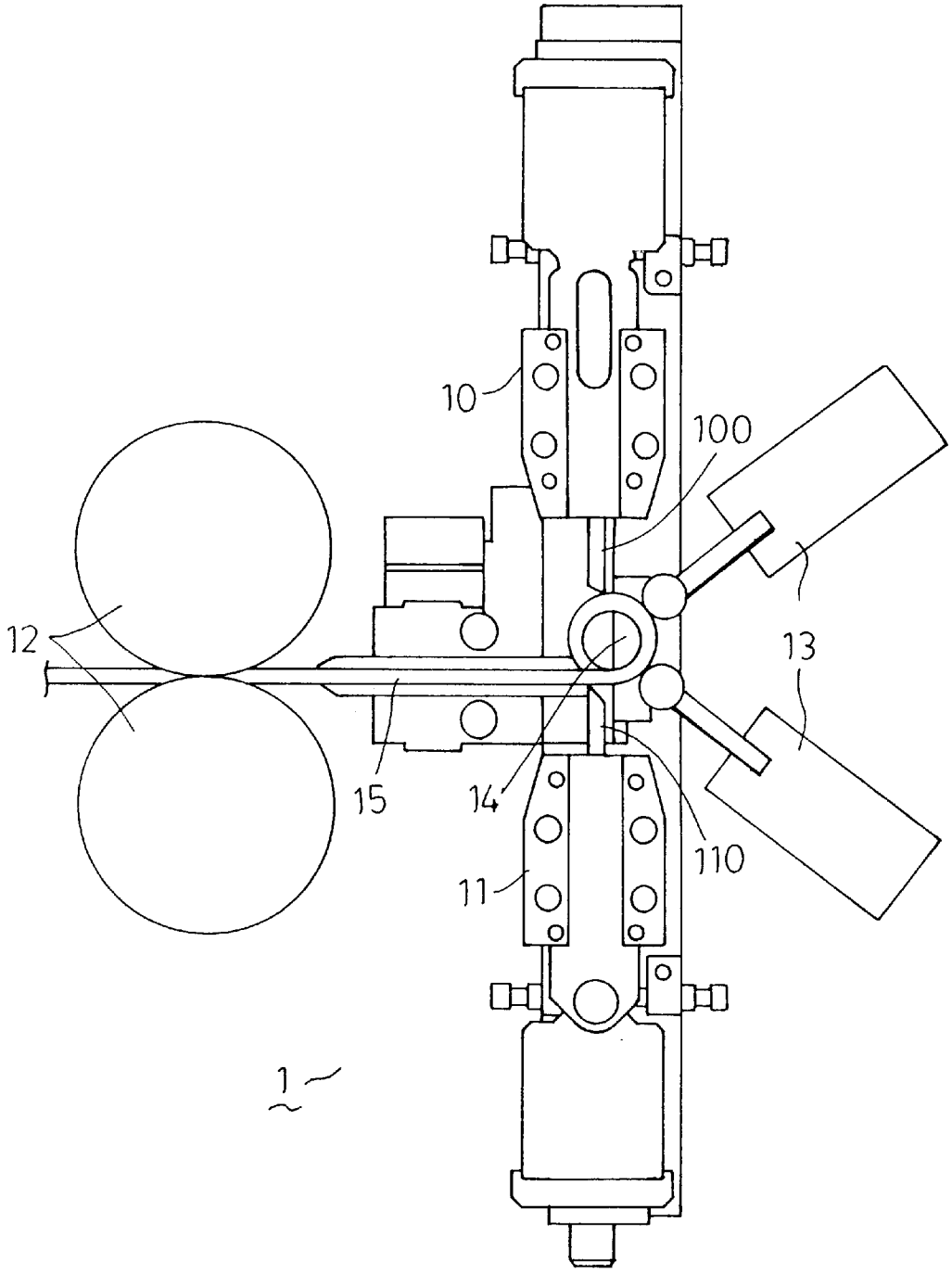
FIG. 1 PRIOR ART
FIG. 1 is a schematic side view illustrating how a metal strip is dealt with in a conventional spring forming machine in order to form a coiled spring.
Figure 2:
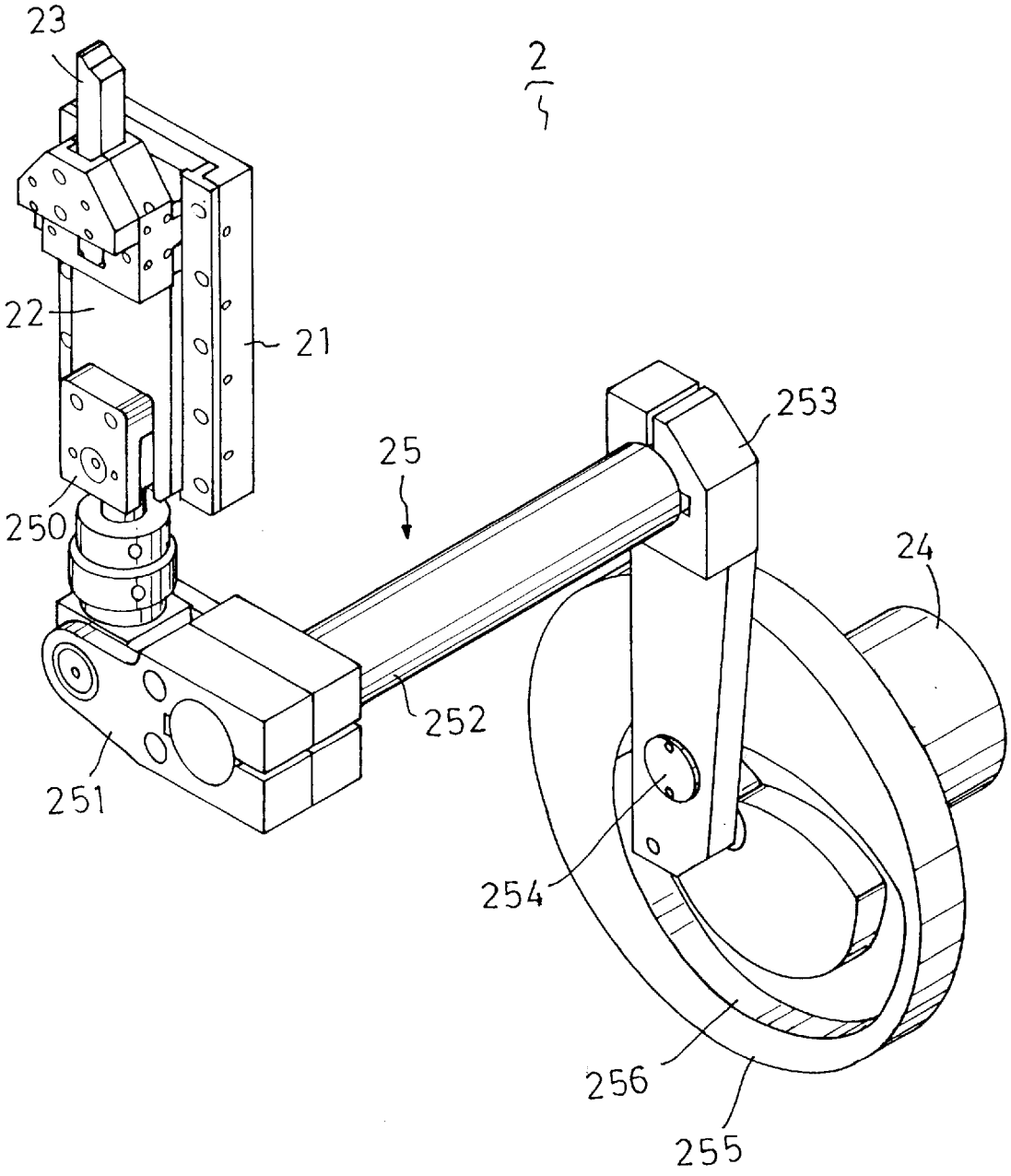
FIG. 2 PRIOR ART
FIG. 2 is a perspective view of a driving mechanism of the conventional spring forming machine.
Figure 3:
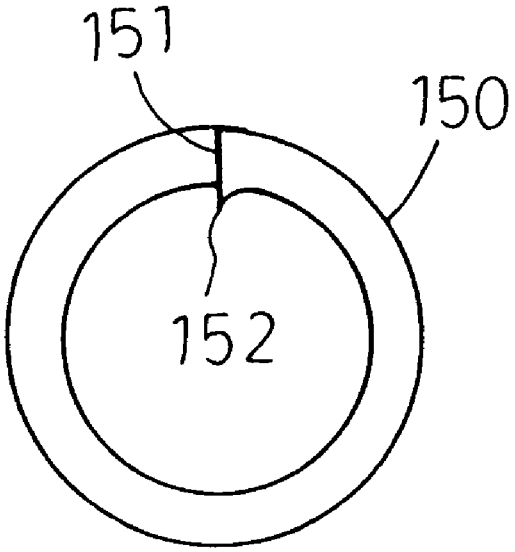
FIG. 3 PRIOR ART
FIG. 3 is a schematic side view illustrating how a sharp projection is formed on a flat end surface of a coiled spring, which is formed by means of the conventional spring forming machine of FIG. 1.
Figure 4:
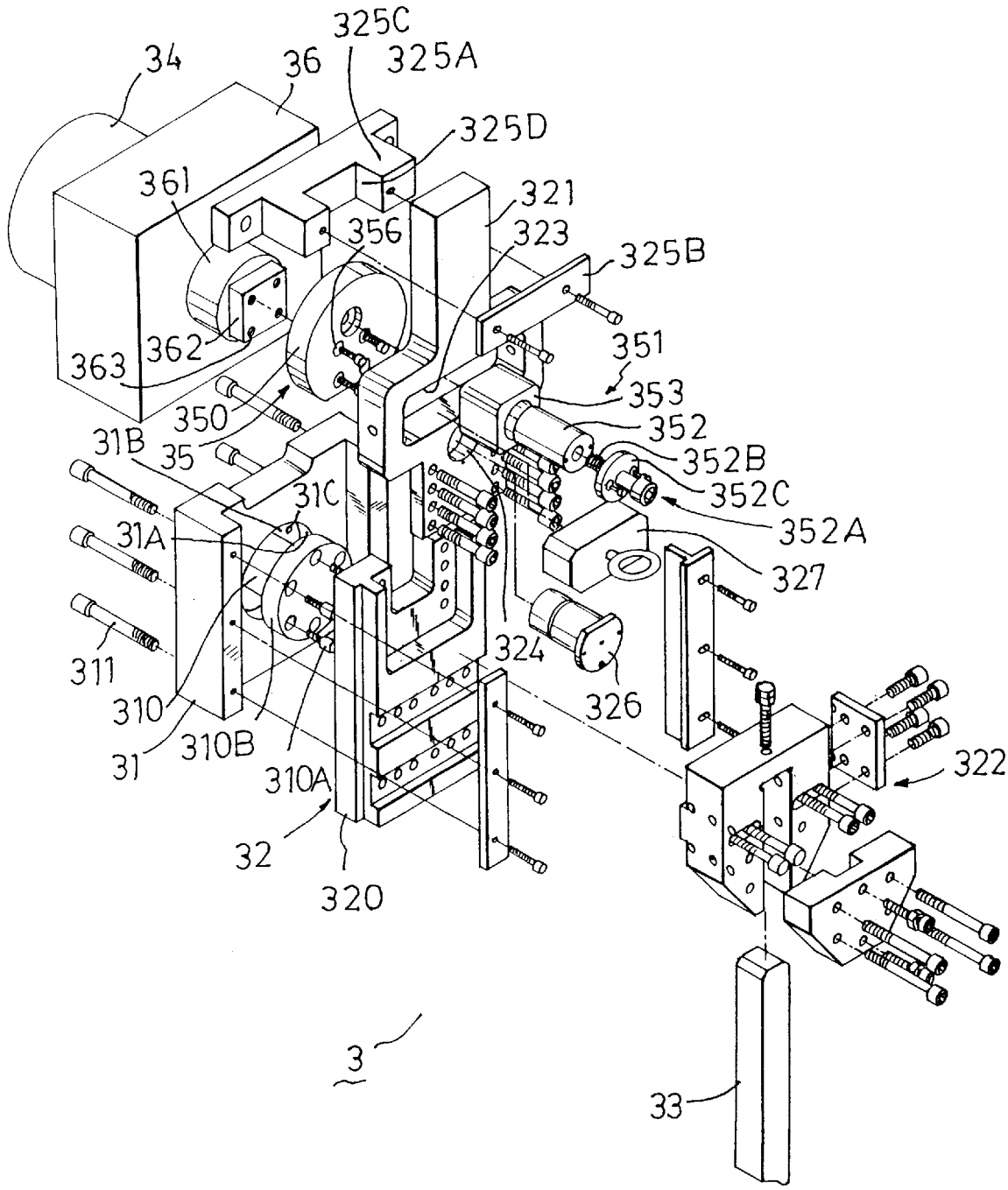
FIG. 4 is an exploded perspective view of the preferred embodiment of a driving mechanism for moving a movable member in a spring forming machine according to this invention.

Referring to FIG. 4, the preferred embodiment of a driving mechanism 3 for moving a movable member in a spring forming machine is shown to include a slide plate seat 31, a slide plate assembly 32 for carrying a movable member 33 thereon, a power source 34, a cam assembly 35, and a speed reduction device 36.

The slide plate seat 31 has a central hole 31A formed therethrough, an inwardly projecting flange 31B formed with a plurality of threaded holes 31C (only one is shown in FIG. 4), and a rotating shaft 310, which is journalled on a machine frame 4 (see FIG. 6) and which is connected fixedly to the flange 31B by means of a plurality of bolts 310A. The rotating shaft 310 extends through the central hole 31A in the slide plate seat 31, and has an integral end plate 310B, which abuts against the slide plate seat 31 to prevent removal of the slide plate seat 31 from the machine frame 4 (see FIG. 6). The slide plate seat 31 is adapted to be fixed on the machine frame 4 (see FIG. 6) by means of a plurality of bolts 311. When the bolts 311 are removed from the slide plate seat 31, the slide plate seat 31 can rotate about the rotating shaft 310.

The slide plate assembly 32 includes an elongated slide plate 320 with a cross-shaped connecting member 321 screwed thereto, a holder 322 for holding the movable member 33 thereon, a horizontal slide slot 323 formed through the connecting member 321, a circular hole 324 formed through the connecting member 321, a guide member 325, a follower shaft 326, and a filler 327.

The slide plate 320 can slide within a vertical slide slot 31D (see FIG. 6) in the slide plate seat 31.

The guide member 325 includes a fixing member 325A and a retaining plate 325B, which is screwed onto a U-shaped portion 325C of the fixing member 325A to define a guide slot 325D therebetween. An end portion of the connecting member 321 can slide within the guide slot 325D.

Figure 8:
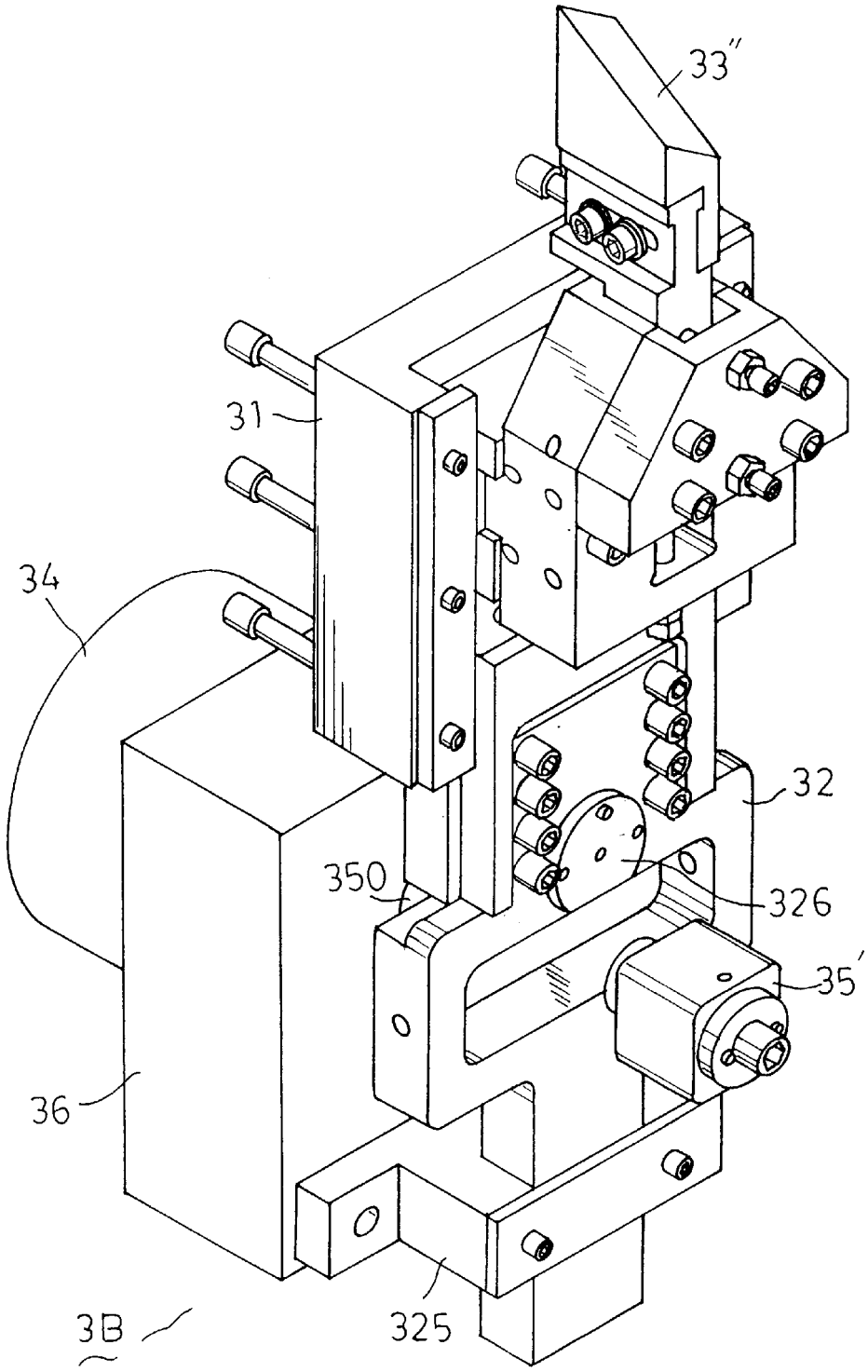
FIG. 8 is a perspective view of the preferred embodiment in a second assembled condition, in which a pitch control rod can move in the machine along a straight path.
Figure 9:
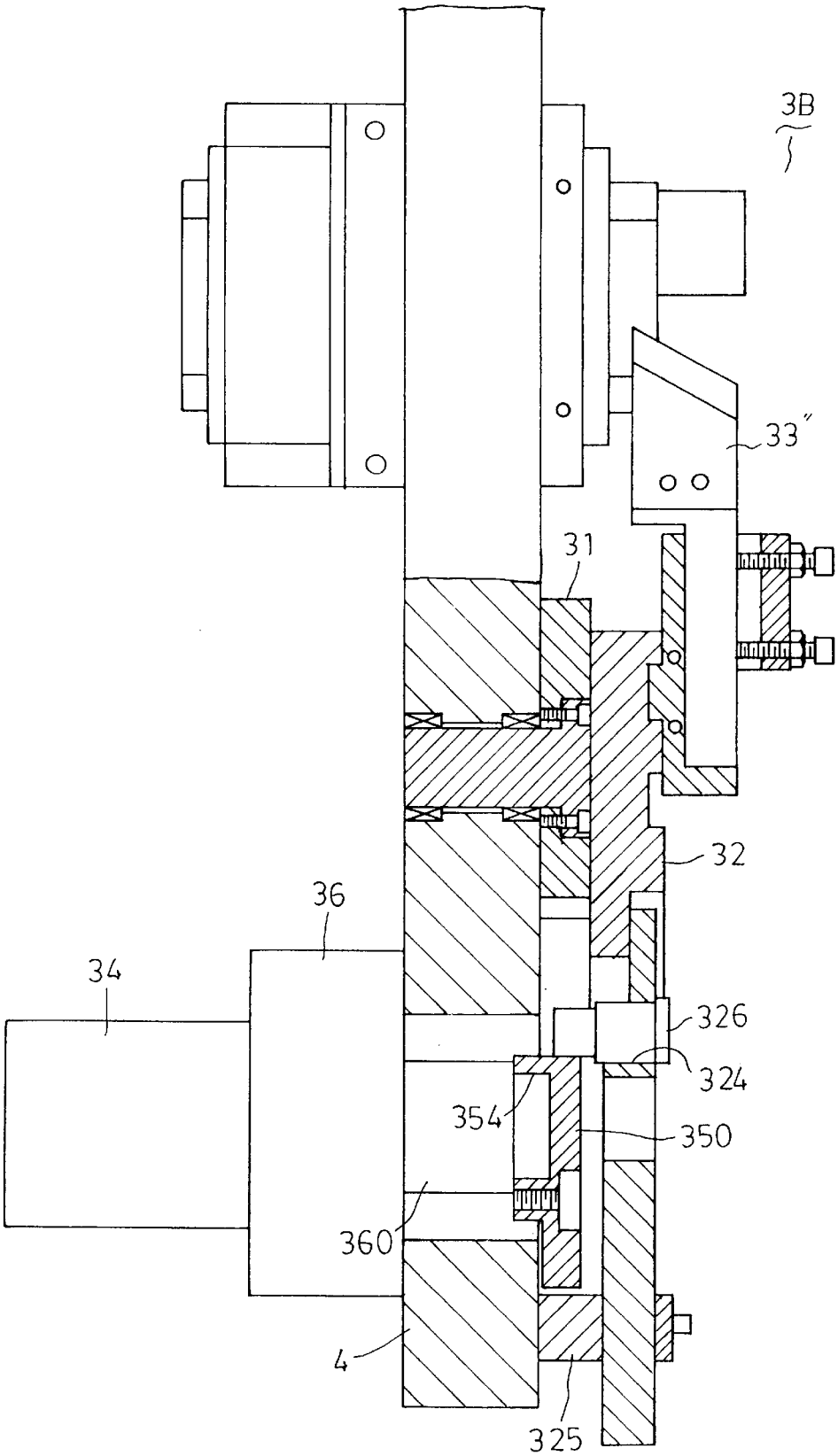
FIG. 9 is a sectional side view of the preferred embodiment in the second assembled condition.

The movable member 33 is a cutter 33' (see FIGS. 10 and 11) or a pitch control rod 33" (see FIGS. 8 and 9).

Figure 7:
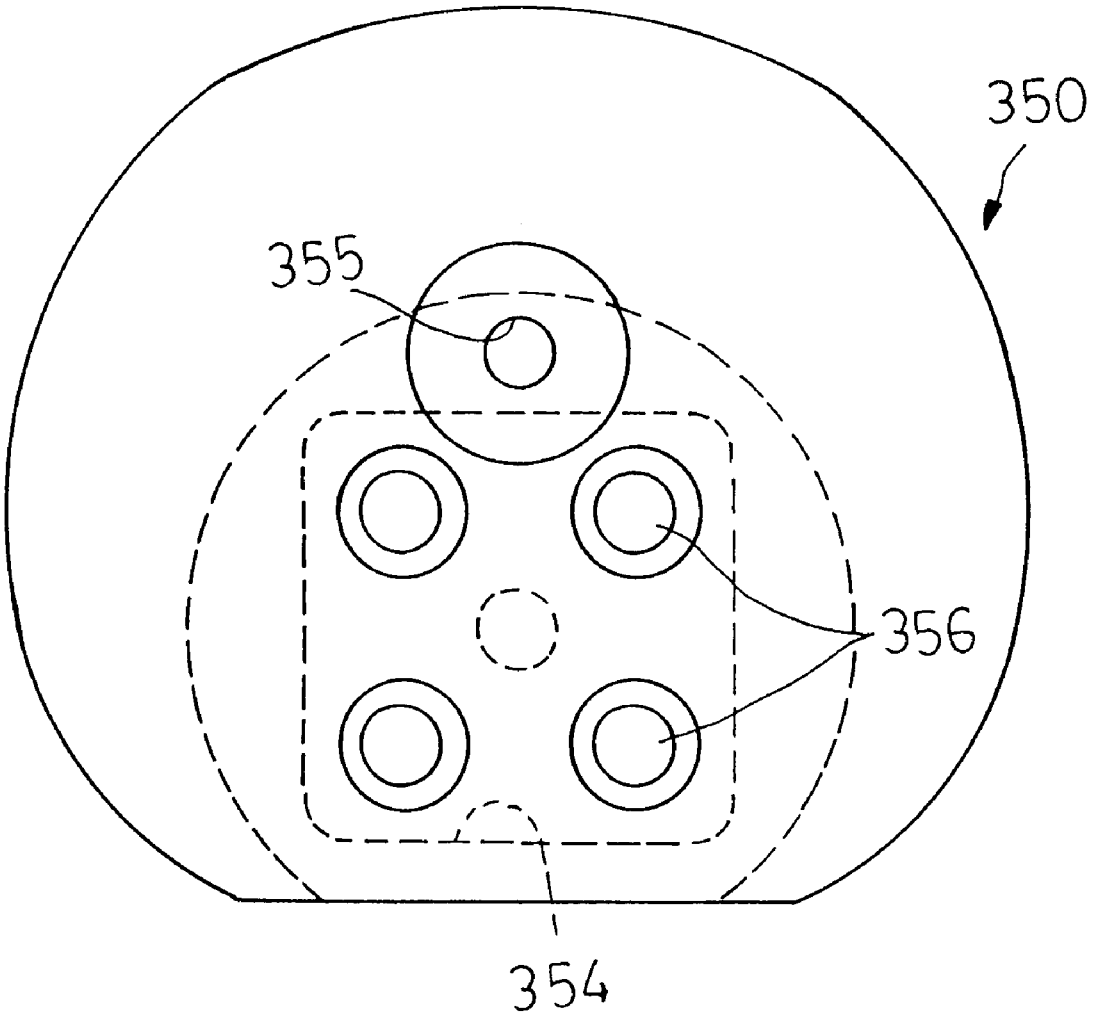
FIG. 7 is an elevational view of a cam wheel of the preferred embodiment.

The cam assembly 35 includes a cam wheel 350 which has an outer periphery of a predetermined shape, and an eccentric pin unit 351. The pin unit 351 includes a hollow pin 352, a retaining member 352A which has a threaded rod 352B that extends through the pin 352 to engage a threaded hole 355 (see FIG. 7) in the cam wheel 350, and an annular sliding block 353, which is sleeved rotatably on the pin 352. The retaining member 352A further includes a retaining ring 352C, which is sleeved movably on the threaded rod 352B and which is bolted onto the pin 352. The sliding block 353 and the filler 327 are fitted within the horizontal slide slot 323 in the connecting member 321 to prevent movement of the sliding block 353 within the horizontal slide slot 323. The sliding block 353 is received in the horizontal slide slot 323 to leave a space in the horizontal slide slot 323 between the sliding block 353 and the connecting member 321, within which the filler 327 is press-fitted.

The speed reduction device 36 is interposed between the power source 34 and the cam wheel 350, and has an output shaft 361 with an output end portion 362 of a rectangular cross-section, which engages fittingly a rectangular groove 354 in the cam wheel 350 and which is screwed onto the cam wheel 350 by four bolts 350B that extend through holes 356 (see FIG. 7) in the cam wheel 350 to engage threaded holes 363 in the output shaft 361 of the speed reduction device 36.

Figure 5:
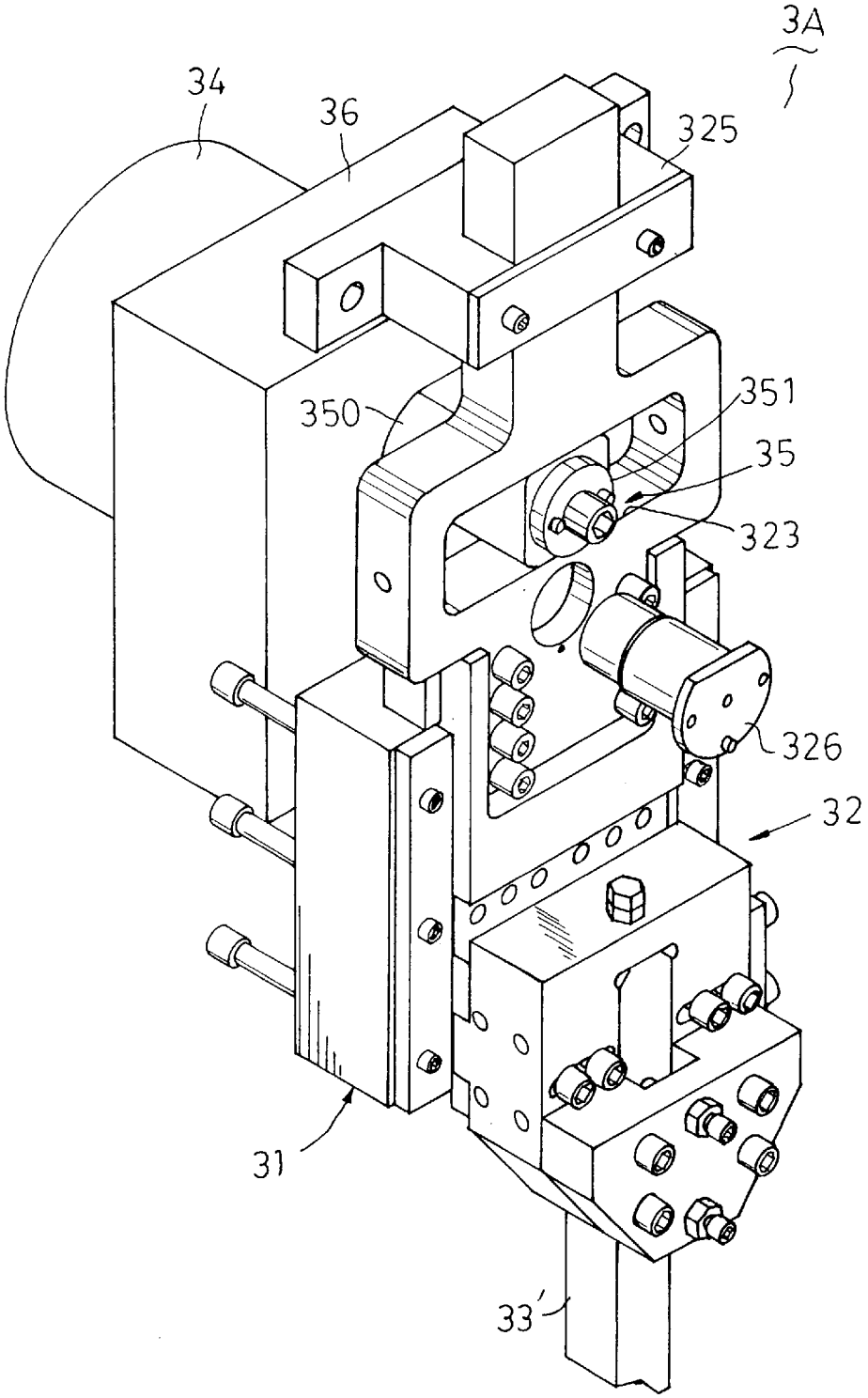
FIG. 5 is a perspective view of the preferred embodiment in a first assembled condition, in which a cutter can move in the machine along a straight path.
Figure 6:
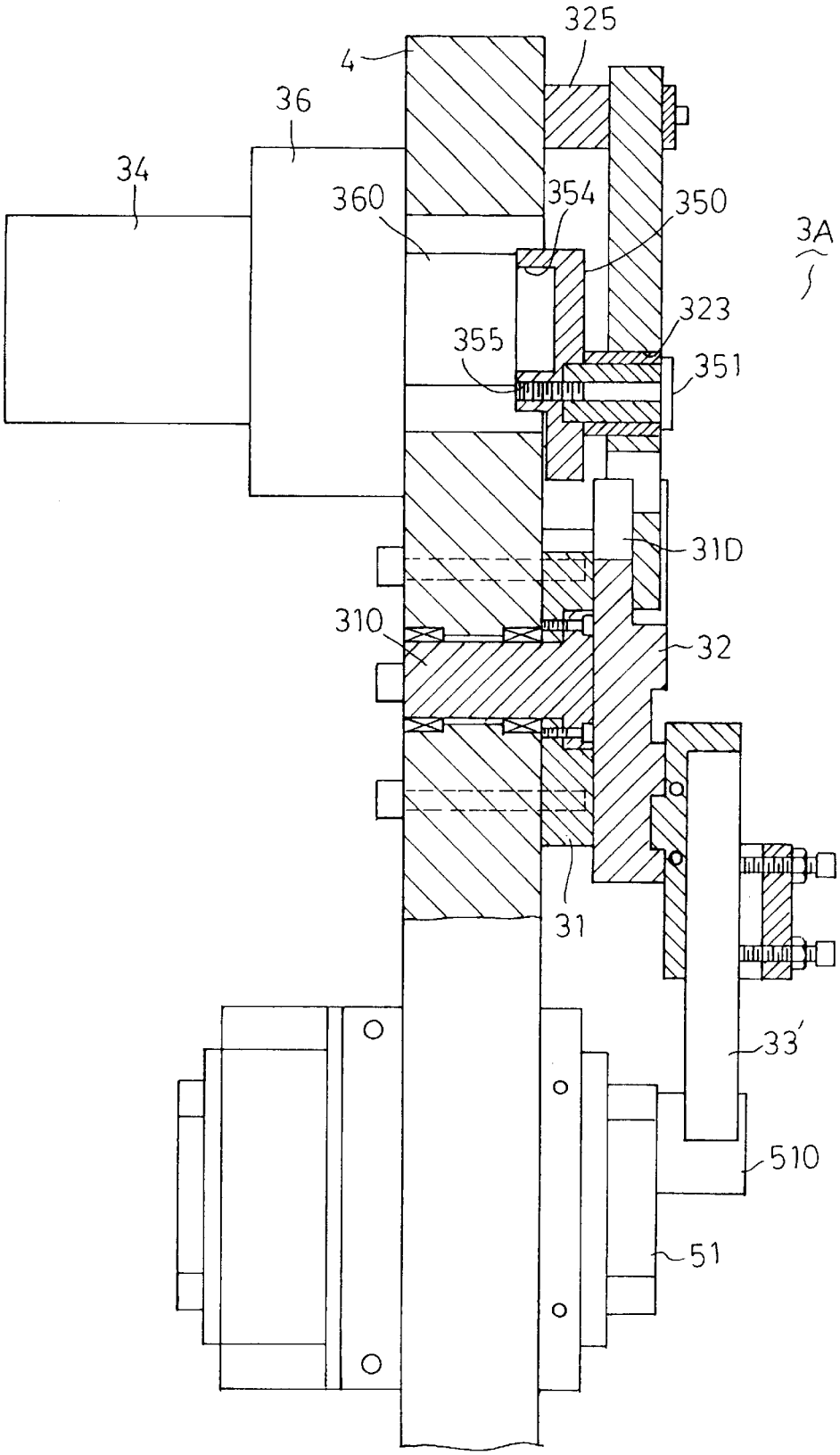
FIG. 6 is a sectional side view of the preferred embodiment in the first assembled condition.

FIGS. 5 and 6 illustrate a first assembled condition of the preferred embodiment, which acts as a first cutting device 3A for cutting a coiled spring. Under this condition, the follower shaft 326 (see FIG. 4) and the filler 327 (see FIG. 4) are removed from the slide plate assembly 32. As such, upon actuation of the power source 34, the cam wheel 350 rotates to move the sliding block 353 in the horizontal slide slot 323 in the connecting member 321 so as to move the slide plate 320 within the vertical slide slot 31D in the slide plate seat 31, thereby moving a movable member or cutter 33' along a straight path in the machine. FIGS. 8 and 9 illustrate a second assembled condition of the preferred embodiment, which acts as a pitch control device 3B. Under this condition, the eccentric pin unit 321 (see FIG. 4)is removed from the cam wheel 350 and the connecting member 321, and the filler 327 (see FIG. 4) is removed from the slide plate assembly 32. As such, upon actuation of the power source 34, the follower shaft 326 is located directly over the cam wheel 350, and the cam wheel 350 pushes the follower shaft 326 upward and downward so as to move the slide plate 320 within the vertical slide slot 31D in the slide plate seat 31, thereby moving a movable member or pitch control rod 33" along a straight path in the machine.

Figure 10:
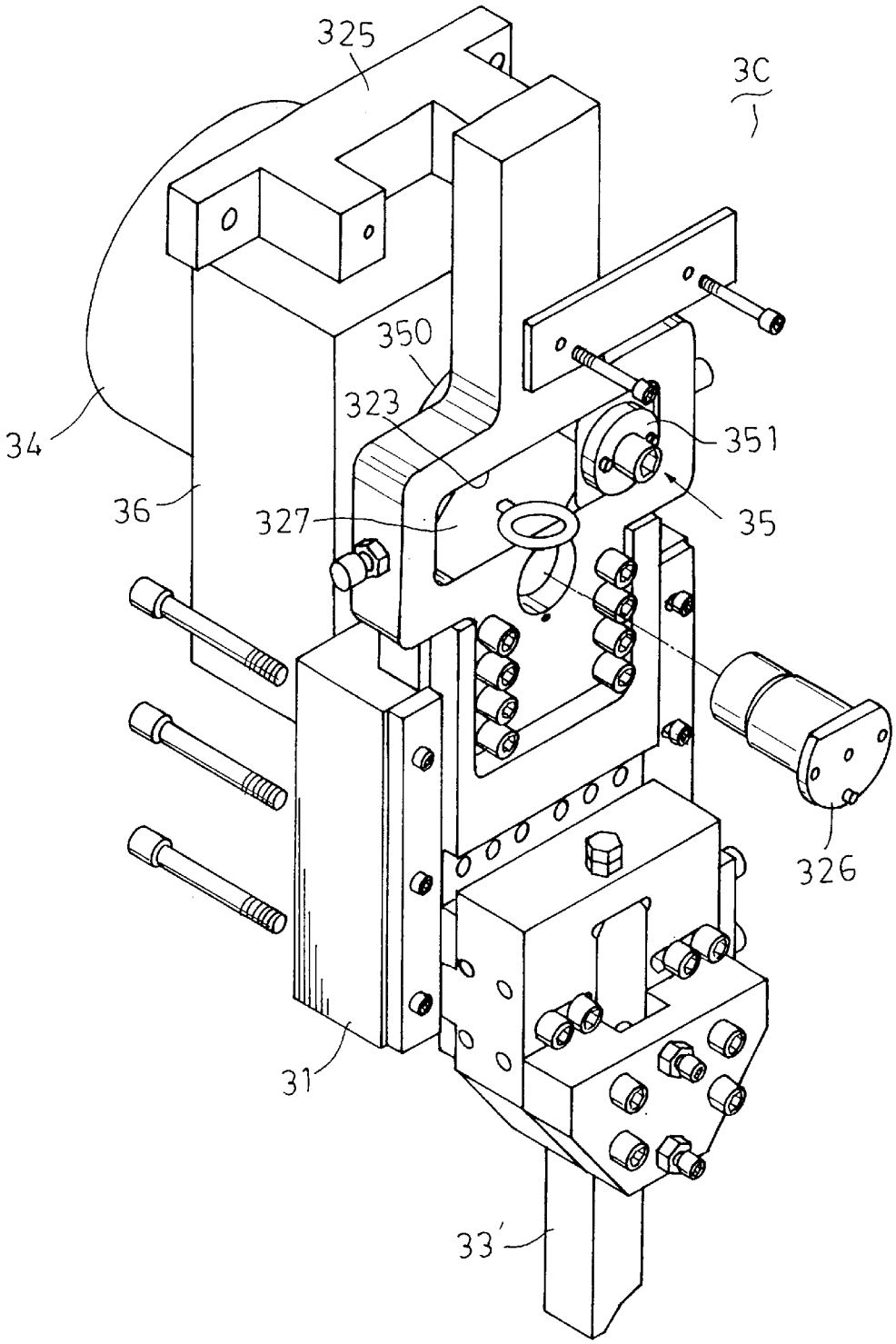
FIG. 10 is a perspective view of the preferred embodiment in a third assembled condition, in which a pitch control rod can move in the machine along a straight path.
Figure 11:
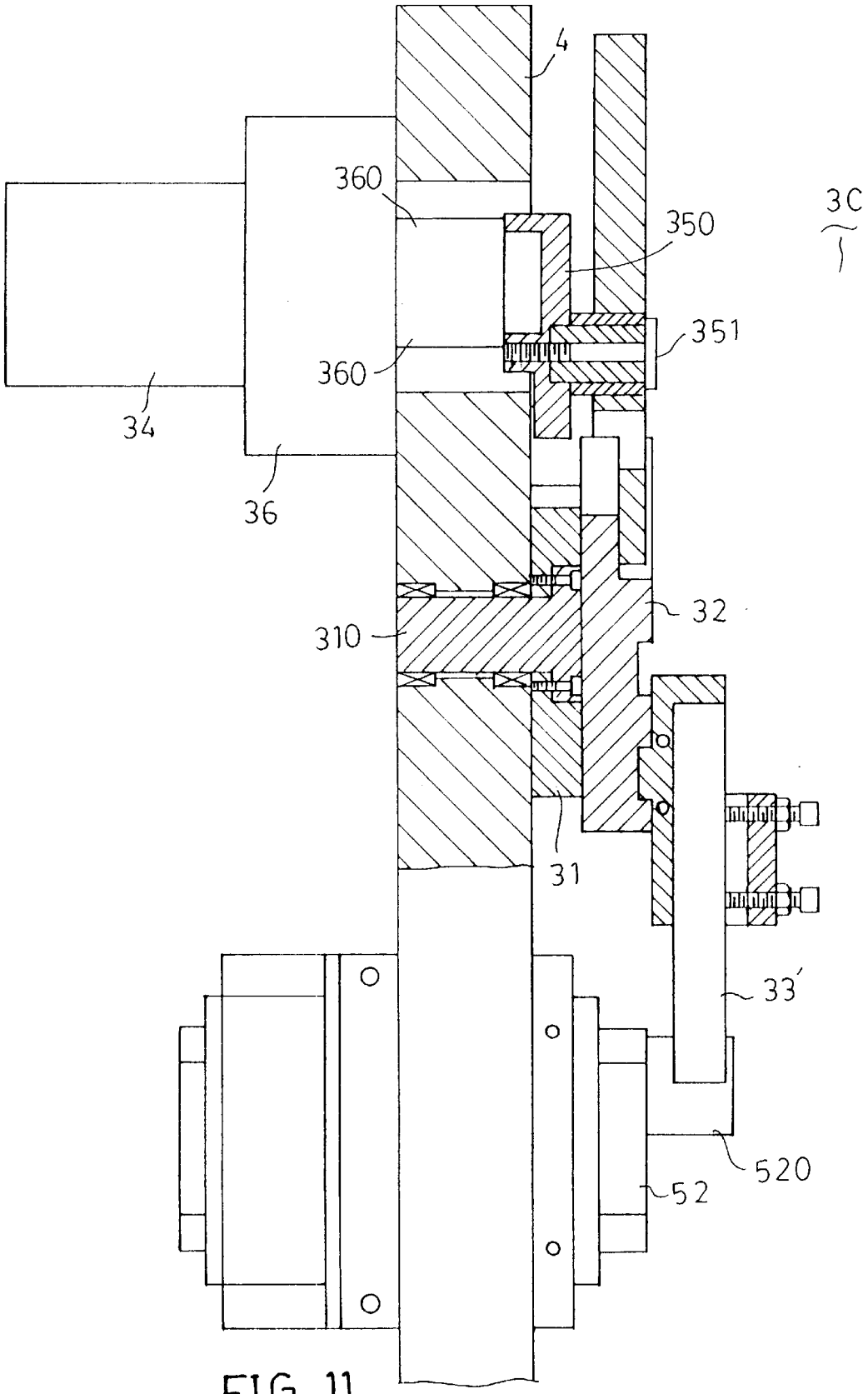
FIG. 11 is a sectional side view of the preferred embodiment in the third assembled condition.
Figure 12:
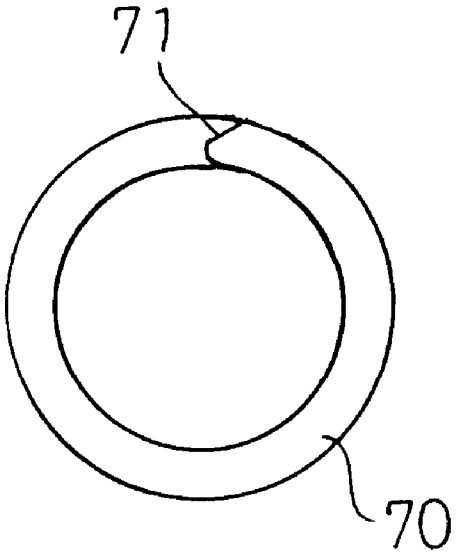
FIG. 12 is a schematic view illustrating how a coiled metal strip is cut along an elliptical path by the preferred embodiment, which is in the third assembled condition.

FIGS. 10 and 11 illustrate a third assembled condition of the preferred embodiment, which acts as a second cutting device 3C for cutting a coiled spring. Under this condition, the bolts 311 and the guide member 325 (see FIG. 4) are removed from the machine frame 4, and the follower shaft 326 (see FIG. 4) is removed from the slide plate assembly 32. As such, upon actuation of the power source 34, the cam wheel 350 rotates to cause movement of the slide plate 320 within the vertical slide slot 31D in the slide plate seat 31 and rotation of the slide plate seat 31 about the rotating shaft 310, thereby moving a movable member or cutter 33' along an elliptical path in the machine. In this way, as shown in FIG. 12, a coiled spring 70 is cut by the cutter 33' along a curved path 71. Accordingly, a sharp projection will not be formed on a cut end surface of the coiled spring 70.

Figure 13:
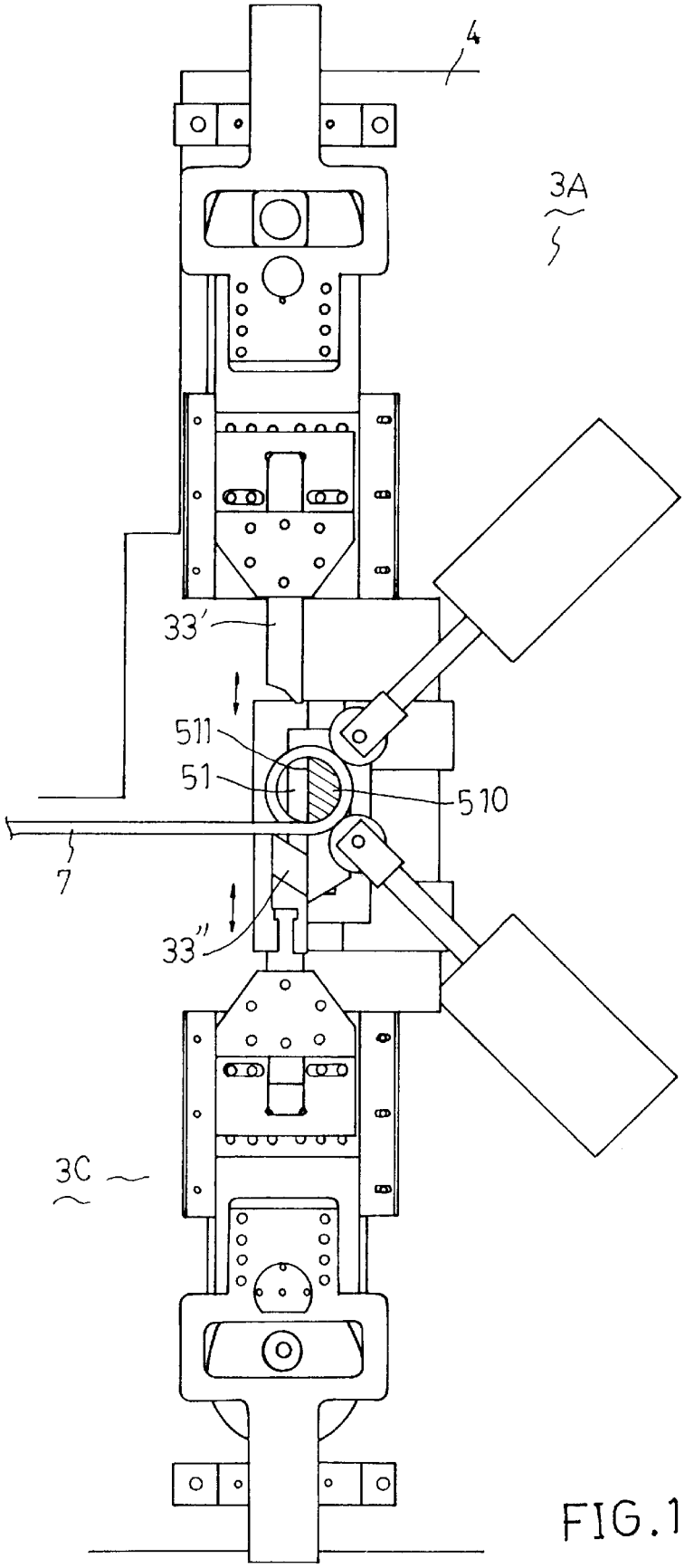
FIG. 13 illustrates one application of the preferred embodiment in a cutting device and a pitch control device of a spring forming machine in the first and second assembled conditions.
Figure 14:
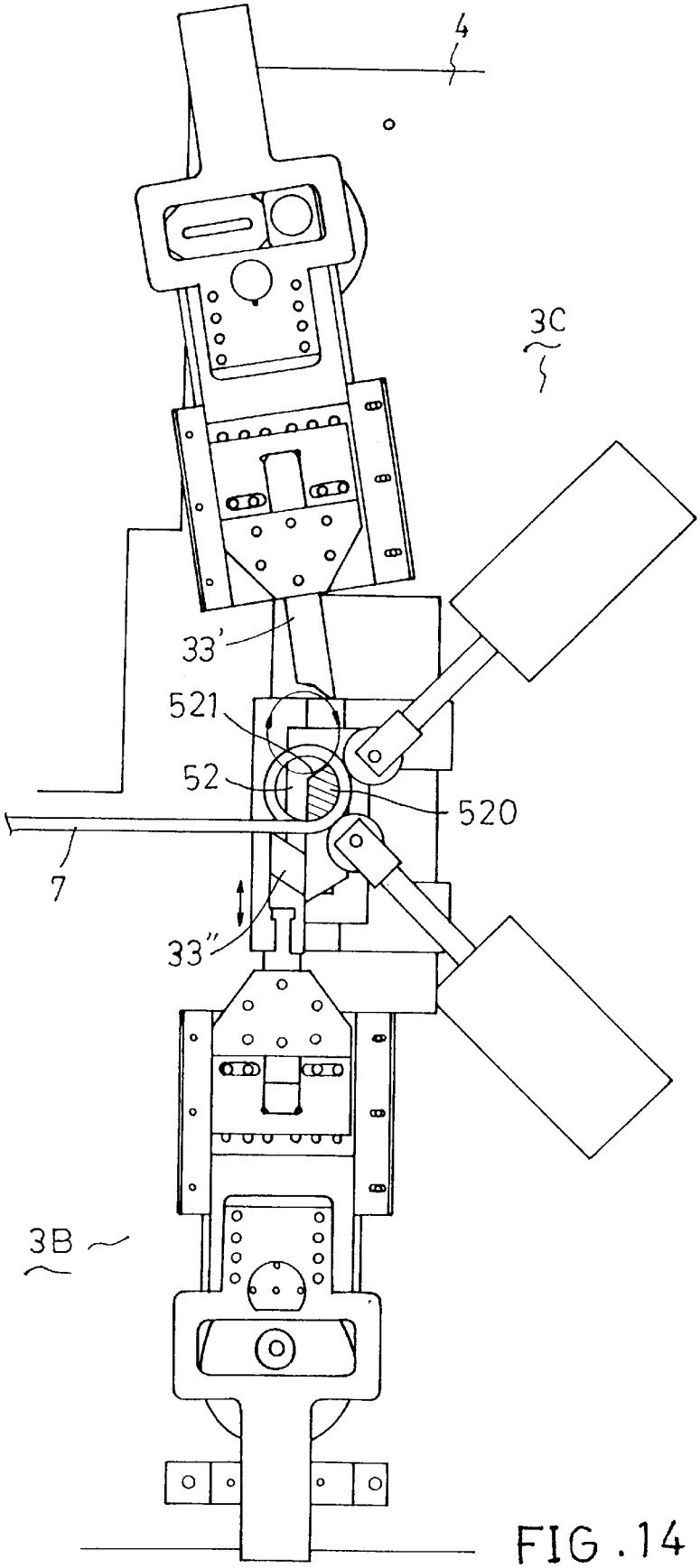
FIG. 14 illustrates another application of the preferred embodiment in a cutting device and a pitch control device of a spring forming machine in the second and third assembled conditions.

The preferred embodiment of this invention can be used on a spring forming machine in two manners illustrated in FIGS. 13 and 14. In FIG. 13, a first cutting device 3A shown in FIGS. 5 and 6 is mounted on a spring forming machine. To cooperate with the vertical movement of a cutter 33', a positioning horizontal cylinder 51 is mounted on the machine, and has a semi-cylindrical integral projection 510 at an end thereof, which has a vertical surface 511. The vertical surface 511 of the projection 510 facilitates formation of a flat end surface of a coiled metal strip 7 to be cut. In FIG. 14, a third cutting device 3C shown in FIGS. 10 and 11 is mounted on a spring forming machine. To cooperate with the elliptical movement of a cutter 33', a positioning horizontal rod 52 is mounted on the machine, and has an integral projection 520 at an end thereof, which has an inclined flat surface 521.

With this invention thus explained, it is apparent that numerous modifications and variations can be made without departing from the spirit and scope of this invention. It is therefore intended that this invention be limited only as indicated by the appended claims.

I claim:

1. A driving mechanism for moving a movable member in a spring forming machine, the machine having a machine frame, said driving mechanism comprising:

a power source;

a slide plate seat being mounted removably on the machine frame and having a vertical slide slot formed therein;

an elongated slide plate carrying the movable member thereon and disposed slidably within said vertical slide slot in said slide plate seat, said slide plate having a horizontal slide slot, which is formed therethrough and which extends in a direction perpendicular to said vertical slide slot in said slide plate seat;

a cam wheel driven by said power source to rotate; and an eccentric pin unit which is mounted eccentrically, rotatably and removably on said cam wheel and which extends slidably into said horizontal slide slot in said slide plate, sliding movement of said eccentric pin unit in said horizontal slide slot causing sliding movement of said slide plate within said vertical slide slot in said slide plate seat;

a guide member, which is fixed to the machine frame and which has a guide slot that is formed through said guide member and that is aligned with said vertical slide slot, said slide plate having two end portions, which extend into said vertical slide slot and said guide slot;

whereby, said movable member moves in the machine frame along a straight path upon actuation of said power source.

2. A driving mechanism for moving a movable member in a spring forming machine, the machine having a machine frame, said driving mechanism comprising:

a power source;

a slide plate seat being mounted removably on the machine frame and having a vertical slide slot formed therein;

an elongated slide plate carrying the movable member thereon and disposed slidably within said vertical slide slot in said slide plate seat, said slide plate having a horizontal slide slot, which is formed therethrough and which extends in a direction perpendicular to said vertical slide slot in said slide plate seat;

a cam wheel driven by said power source to rotate and having an outer periphery of a predetermined shape; and a follower shaft mounted removably on said slide plate and contacting said outer periphery of said cam wheel, rotation of said cam wheel causing movement of said slide plate in said vertical slide slot in said slide plate seat;

whereby, said movable member moves in the machine frame along a straight path upon actuation of said power source.

3. A driving mechanism as claimed in claim 2, further comprising a guide member, which is fixed to the machine frame and which has a guide slot that is formed through said guide member and that is aligned with said vertical slide slot, said slide plate having two end portions, which extend respectively into said vertical slide slot and said guide slot.

4. A driving mechanism as claimed in claim 2, wherein said slide plate has a circular hole formed therethrough, said follower shaft being press fitted within said circular hole and being formed with an integral end plate, which is located at an end of said follower shaft and which abuts against said slide plate.

5. A spring forming machine including a machine frame, a movable member, and a driving mechanism moving said movable member on said machine frame, wherein the improvement comprises said driving mechanism including:

a power source;

a slide plate seat with a vertical slide slot formed therein;

a rotating shaft connected fixedly to said slide plate seat and journalled on the machine frame;

an elongated slide plate carrying the movable member thereon and disposed slidably within said vertical slide slot in said slide plate seat, said slide plate having a horizontal slide slot, which is formed therethrough and which extends in a direction perpendicular to said vertical slide slot in said slide plate seat;

a cam wheel driven by said power source to rotate;

an eccentric pin unit which is mounted eccentrically, rotatably and removably on said cam wheel and which extends into said horizontal slide slot in said slide plate to leave a space in said horizontal slide slot; and a filler press fitted within said space in said horizontal slide slot in said slide plate to prevent movement of said pin unit in said horizontal slide slot;

whereby, upon actuation of said power source, said slide plate seat rotates on the machine frame, and said slide plate moves along said vertical slide slot in said slide plate seat, thereby permitting movement of the movable member along an elliptical path on the machine frame.

6. A spring formed machine as claimed in claim 5, wherein said machine frame has a plurality of holes formed therethrough, said slide plate seat having a plurality of threaded hole formed therein, said driving mechanism further including a plurality of bolts, which extend respectively through said holes in said machine frame to engage said threaded holes in said slide plate seat, thereby locking said slide plate seat on said machine frame, whereby, when said filler and one of said eccentric pin unit and said follower shaft are removed from remainder of said machine frame, said movable member moves on said machine frame along a straight path upon actuation of said power source.

* * * * *